US006095848A

United States Patent [19]

Munshi

[11] Patent Number: 6,095,848

[45] Date of Patent: Aug. 1, 2000

[54] ELECTRICAL POWER OUTLET AND SWITCH

[75] Inventor: Rafik Munshi, Lakehaven, Australia

[73] Assignee: Krone GmbH, Berlin-Zehlendorf, Germany

[21] Appl. No.: 09/200,217

[22] Filed: Nov. 25, 1998

[30] Foreign Application Priority Data

Dec. 2, 1997 [AU] Australia ..... PP0680

[51] Int. Cl.[7] ..... H01R 4/24

[52] U.S. Cl. ..... 439/417; 439/107

[58] Field of Search ..... 439/395, 404, 439/405, 417, 412, 409, 650, 651, 652, 654, 535, 536

[56] References Cited

U.S. PATENT DOCUMENTS

| | | | |
|---|---|---|---|
| 3,860,319 | 1/1975 | Slater | 439/400 |
| 3,868,161 | 2/1975 | Frantz | 439/107 |
| 4,223,971 | 9/1980 | Dola et al. | 439/395 |
| 4,775,332 | 10/1988 | Bowden, Jr. et al. | 439/650 |
| 5,088,934 | 2/1992 | Chow et al. | 439/395 |
| 5,685,733 | 11/1997 | Janczak | 439/395 |

*Primary Examiner*—Khiem Nguyen
*Assistant Examiner*—Son V. Nguyen
*Attorney, Agent, or Firm*—McGlew and Tuttle, P.C.

[57] ABSTRACT

An electrical power outlet or switching device suitable for installation as fixtures in household and commercial buildings is provided with improved mechanisms for making contact with the building wiring. Contact members having slots between contact edges are provided to enable an end of an insulated wire or cable to be inserted therein. Upon insertion the contact edges cut through portions of the insulation to make electrical connection to the conductor therein and to mechanically secure the wire/cable end also. In one arrangement, a slidable block is provided adjacent the slot and having an aperture therethrough which can be aligned with a widened portion of the slot. A wire/cable end can be inserted in the aperture and widened slot portion and the block slid along the slot to force the wire/cable end into the slot and engagement with the contact edges. The connection system enables fast and efficient connection of wiring to the power outlet or switching device.

25 Claims, 9 Drawing Sheets

FIG 2
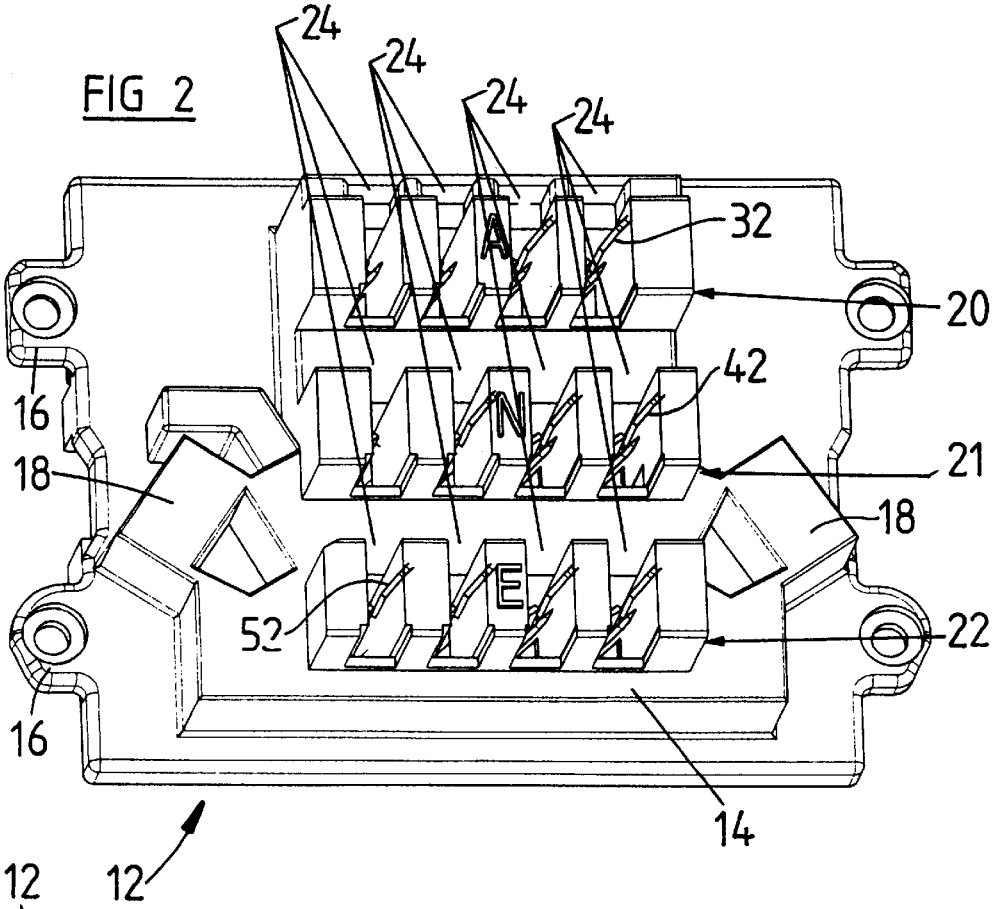
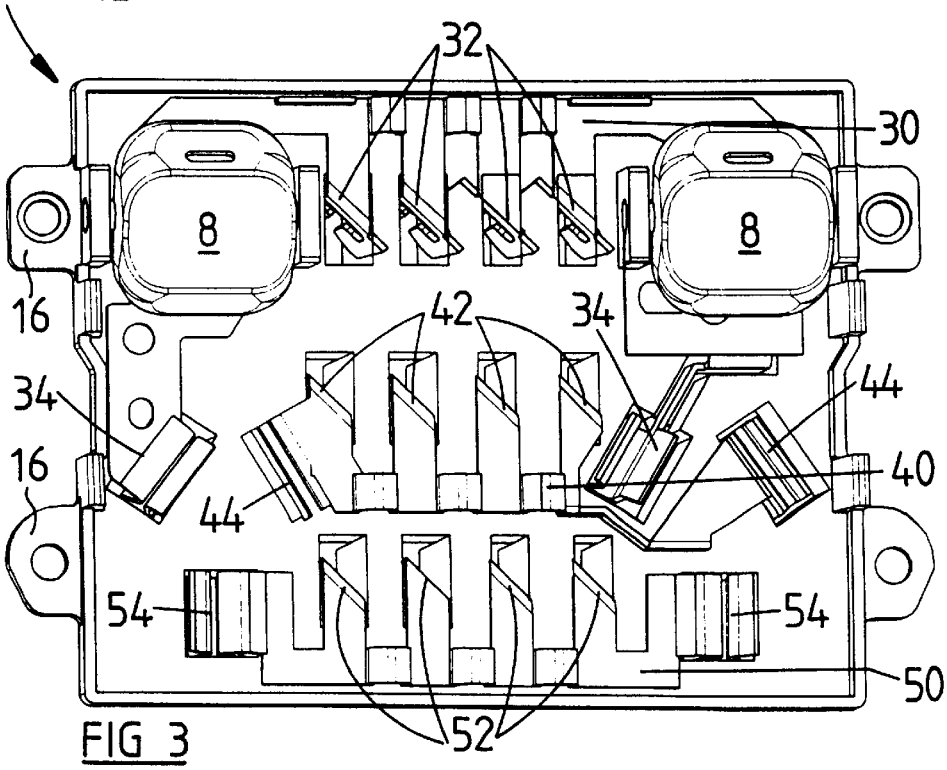
FIG 3

FIG 4
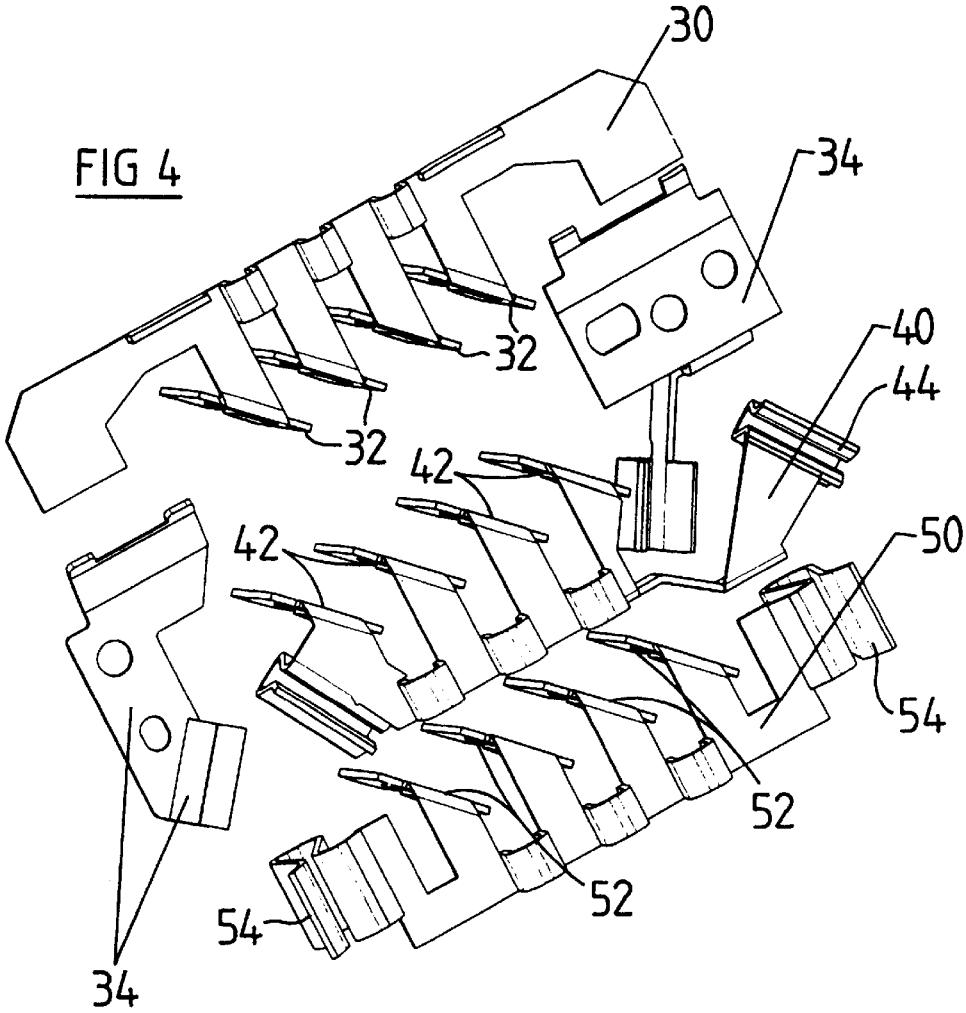
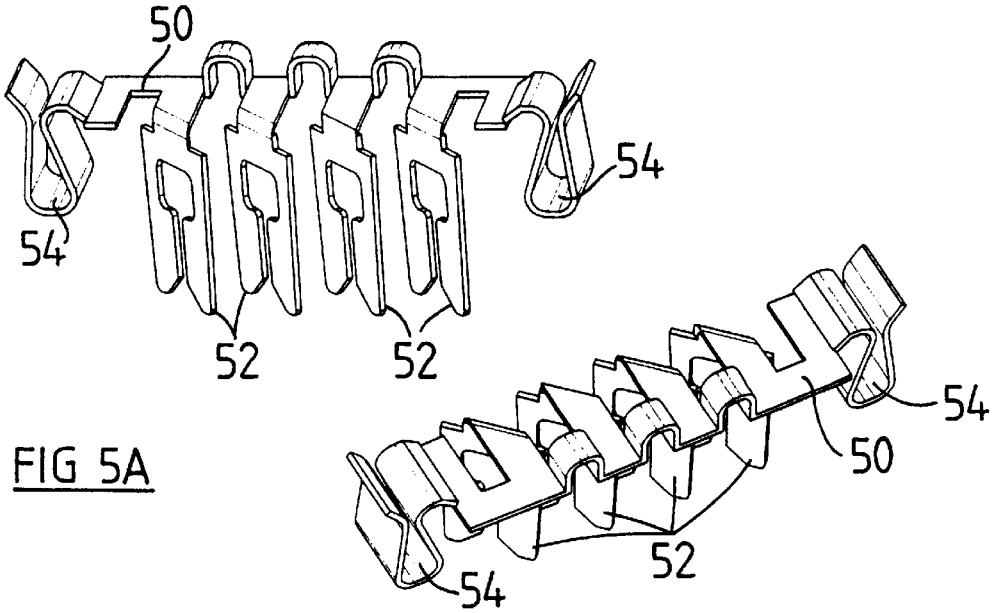
FIG 5A

ELECTRICAL POWER OUTLET AND SWITCH

FIELD OF THE INVENTION

This invention relates to electrical power outlet sockets and electrical power switches.

BACKGROUND OF THE INVENTION

Electrical power outlet sockets are used extensively in domestic and commercial buildings for providing outlets from which electrical apparatus can be supplied with electrical power from main transmission lines. For example, in Australia, an electrical power outlet socket may typically be installed in a lower region of a wall, and have socket receptacles for three plug pins corresponding to an active (e.g. energized, also referred to as hot, live and alive), a neutral and an earthing (ground) connection. Connecting wires are installed within the building wall to connect the respective contacts of the socket receptacles to the main electrical power source at, for example, the electrical switching/circuit breaker or fuse box of the building, and to other electrical power outlets in the same region of the building. Traditionally, in order to provide a secure electrical connection between the connecting wires in the wall and the electrical contacts of the power outlet socket, screw contacts have been utilized. A screw contact requires that insulation from an end of the connecting wire be removed, and the exposed conductor of the wire inserted in a contact opening and then engaged into secure electrical contact by screwing a contact screw into the contact opening to physically and electrically engage the exposed conductor portion. Although this is not a particularly difficult operation, if many electrical power outlets are to be installed, it would be desirable to reduce the number and complexity of operations required to make electrical connections to each electrical power outlet.

SUMMARY AND OBJECTS OF THE INVENTION

In accordance with the present invention, there is provided an electrical power outlet having at least one power outlet socket comprising a plurality of socket receptacles with corresponding outlet electrical contacts for making electrical connection with respective pins of an electrical plug when inserted in the socket receptacles, and including a plurality of input electrical contacts electrically coupled to each outlet electrical contact for making electrical connection between the outlet electrical contacts and a main electrical power source, each input electrical contact being adapted to make electrical connection with a wire or cable having an insulating sheath, wherein each input electrical contact has at least one insulation cutting edge or surface adapted to cut through the insulative sheath of an insulated wire or cable and make electrical connection to the conductor therein upon a relative movement between the wire or cable and the input electrical contact.

The principles of the present invention may be equally applied to an electrical power switching unit, such as those used for switching on and off of fixture lights and the like in domestic and commercial buildings. In that case the input electrical contacts would be electrically coupled to at least one respective electrical switching contact rather than electrical outlet contact as in the case of an electrical power outlet.

In one implementation of the invention, each power outlet socket has three outlet electrical contacts corresponding to an energized connection, a neutral connection and a ground connection. Connected to each of these outlet electrical contacts there is a plurality of the input electrical contacts; in the embodiments illustrated and described hereinbelow there are four input electrical contacts in each electrical power outlet, and each electrical power outlet has two power outlet sockets (i.e. two sets of outlet electrical contacts and four sets of input electrical contacts in each electrical power outlet, each set of contacts comprising an energized, neutral and ground).

According to one form of the invention, each of the input electrical contacts comprises a pair of generally parallel contact legs having a slot between respective opposed contact edges of the contact legs. The slot opens outwardly in a generally V-shaped configuration at the ends of the contact legs where the legs taper slightly, which facilitates insertion of an insulated wire or cable into the slot from the open end. Upon insertion of the insulated wire or cable transversely of the slot the contact edges are adapted to cut through the insulating sheath and make electrical connection to the wire or cable conductor therewithin. The wire or cable is also held quite securely in the slot between the contact edges. Obviously the resting width of the slot presented across the wire diameter should be dimensioned to be at least less than the outer diameter of the insulating sheath to allow the contact edges to cut through the insulation, although if the contact legs are resiliently against displacement away from one another the slot can be constructed to receive and make connection to a range of different insulated wire/cable gauges. An end of the wire/cable to be connected to the power outlet socket, for example to supply mains power thereto, is preferably inserted into the slot of an input electrical contact using an insertion tool.

The base of the contact legs are preferably attached to a connecting frame to which the other input electrical contacts and the outlet electrical contacts are also connected. In the preferred form, the frame, input electrical contacts and outlet electrical contacts are all integrally formed from a single piece of an appropriate conducting metal material. This may be formed, for example, by stamping from sheet metal and bending or pressing the stamped contacts and frame into the required shape. In the case of the energized contacts, it is preferred that the outlet electrical contacts be made from separate pieces of material from the input electrical contacts and frame, so that a switching mechanism can be employed to selectively provide electrical connection between the input electrical contacts and the respective outlet electrical contacts.

According to another form of the invention, each of the input electrical contacts comprises a generally flat contact portion with a slot formed therein, the slot having a narrow holding portion with generally parallel contact edges adjacent to a widened insertion portion. The contact edges of the holding portion are spaced so that a wire/cable inserted therein will have its insulation cut by the edges so that the edges make electrical connection with the wire/cable conductor. The insertion portion is dimensioned so that an end of the wire/cable can be inserted therein transversely of the plane of the flat contact portion for subsequent movement parallel to the slot into the holding portion. In this form of the invention it is preferred that a slidable member be provided and supported by the power outlet socket adjacent one flat side of the flat contact portion of the input electrical contact. The slidable member has an aperture therethrough and is slidable so that the aperture can moved from alignment with the insertion portion to alignment with the holding portion. In operation, the insulated end of the wire/cable to which contact is to be made is inserted through the aperture in the slidable member and into the insertion portion of the slot. The slidable member is then moved to alignment with the holding portion of the slot, which in turn forces the wire/cable between the contact edges of the holding portion, cutting through the insulation and making electrical connection between the edges and the wire/cable conductor.

The invention also provides an electrical power switching unit adapted for use in switching electrical power to fixture lights and the like, comprising at least one inlet electrical contact, at least one corresponding outlet electrical contact and a switching means coupled between the at least one inlet and outlet electrical contacts for electrically connecting and disconnecting the corresponding inlet and outlet contacts to control the supply of electrical power between electrical circuits coupled to the at least one inlet and outlet electrical contacts, wherein each of the inlet and outlet electrical contacts are adapted to make electrical connection with a wire or cable having an insulating sheath, and wherein each electrical contact has at least one insulation cutting edge or surface adapted to cut through the insulative sheath of a said insulated wire or cable and make electrical connection to the conductor therein upon a relative movement between the wire or cable and the electrical contact.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS In the drawings:

FIG. 2 is a rear view of an electrical power outlet base portion constructed in accordance with a first embodiment of the invention;

FIG. 3 is a front view of an electrical power outlet base portion constructed in accordance with the first embodiment;

FIG. 4 is a front view of the set of electrical contacts of the first embodiment;

FIG. 5A is a perspective view of the ground contacts of the first embodiment;

DESCRIPTION OF THE PREFERRED EMBODIMENTS

Figure 1:
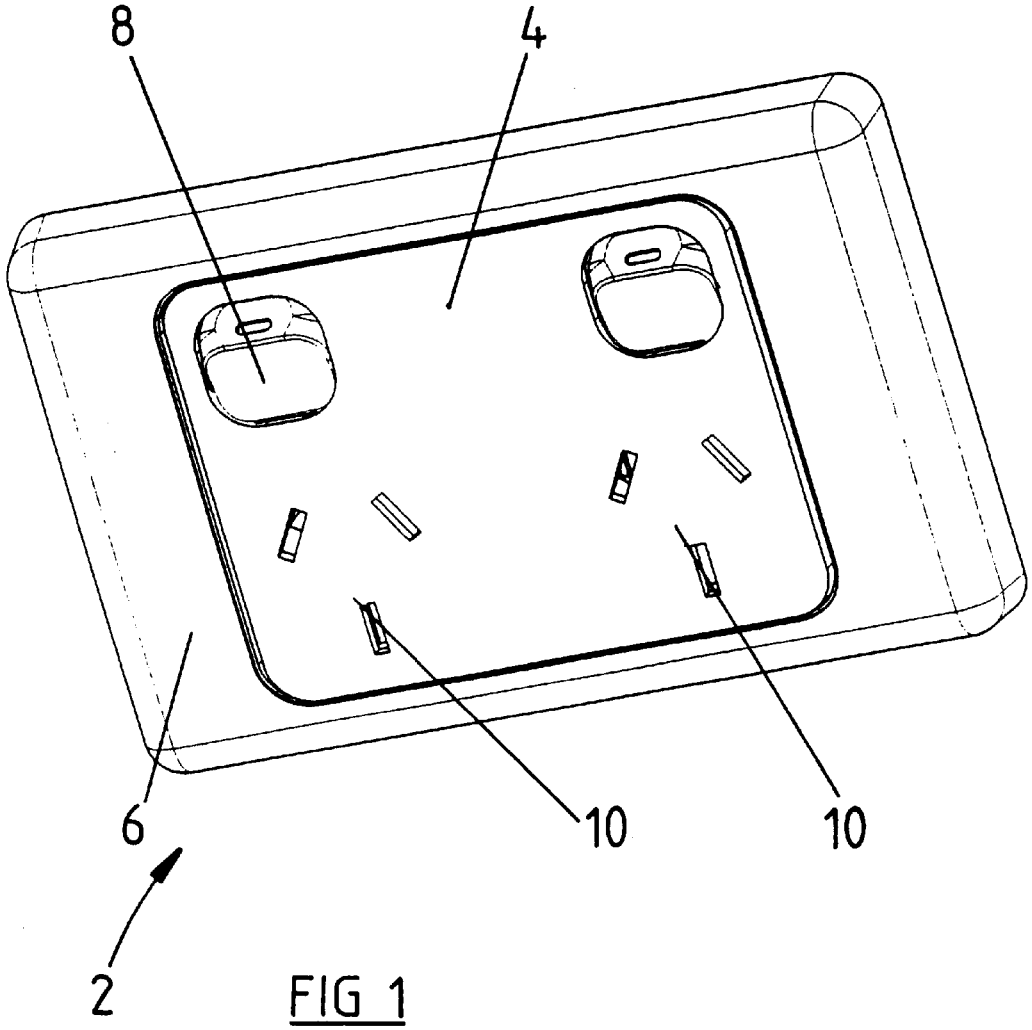
FIG. 1 is a front isometric view of an electrical power outlet having two sockets and corresponding power switches.

Referring to the drawings in particular, a front view of an electrical power outlet 2 is illustrated in FIG. 1, in this case adapted to make separate electrical connection to two standard domestic three pin electrical plugs (these may be of the U.S. type with parallel flat prongs and a lower central cylindrical prong). A face plate 6 and base portion cover 4 cover the electrical power outlet from the front. For each socket 10 the base portion cover has three pin apertures and a corresponding switch 8 which protrudes through the base portion cover.

FIG. 2 illustrates a base portion 12 of an electrical power outlet according to a first embodiment of the present invention from a rear view, and FIG. 3 is a front view of the base portion 12 with base portion cover removed. As can be seen in FIG. 3, two sets of energized, neutral and ground output contacts 34, 44 and 54, respectively, are arranged on the base portion 12, seated in respective recesses of the base portion. When the base portion cover 4 is fitted over the base portion 12, the apertures for the sockets 10 align with respective output contacts, to enable plug pins (or prongs) to be inserted through the apertures to be engaged in the output contacts.

Three sets of input contacts are provided, comprising energized input contacts 32, neutral input contacts 42 and ground input contacts 52. Each set comprises four input contacts, which are interconnected by respective contact frames 30, 40, 50 (corresponding to energized, neutral and ground). In the case of the neutral and ground, the contact frames 40, 50 are also connected directly to the respective neutral and ground output contacts 44, 54. In the case of the energized contact frame 30, however, the energized output contacts 34 are formed separately, so that switches 8 can control electrical connection between the respective energized output contacts 34 and the energized contact frame and input contacts. FIG. 4 illustrates the layout of the contacts and contact frames separately from the base portion 12.

From the front view, each of the input contacts are received in a separate recess in the base portion 12, the four recesses for each of the energized, neutral and ground being arranged in respective horizontal rows. The horizontal rows correspond to three rows of input contact cover turrets 20, 21, 22 (corresponding to energized, neutral and ground) projecting from the rear of the base portion 12. The recesses in the front of the base portion each correspond to a respective wire contact opening 24 in the turrets 20, 21, 22. Accordingly, each input contact is received in a respective wire contact opening 24, within which access to the input contacts is available for making contact thereto with an insulated wire or cable. The output contacts 34, 44, 54 are protected from the rear by outlet contact covers 18 (FIG. 2).

FIG. 5A shows two views of the integrally formed ground input contacts, contact frame and output contacts 52, 50, 54, respectively. The input and output contacts and contact frame are integrally formed from a piece of sheet metal material or the like, by stamping a required shape and then bending or otherwise forming the stamped sheet material into the desired configuration as illustrated in the figure. The contact frame 50 is elongate, with the output contacts 54 positioned at each end, and the input contacts 52 spaced therealong between the two output contacts. The output contacts are of generally conventional form for receiving flat contact pins of a domestic plug or the like, and are generally unshaped and open upwardly as shown in the figure. The input contacts 52 are bent downwardly from the contact frame, and the plane of each input contact is bent so as to extend transversely of the extent of the contact frame, preferably about 45° thereto. Each input contact 52 comprises two parallel legs with a slot therebetween which opens downwardly, the opening being formed in a generally V-shaped configuration at the ends of the contact legs to facilitate insertion of a wire or cable between the contact legs. Along the slot the contact legs have respective contact edges which are parallel and spaced closely enough so that if an insulated wire is inserted therebetween from the slot opening, the contact edges will cut through portions of the insulating sheath and make electrical connection to the conductor therein, and also mechanically engage the wire. The slot may broaden at the base of the legs to provide the legs with slightly greater resilient flexibility to accommodate the wire between the contact edges.

Figure 5C:
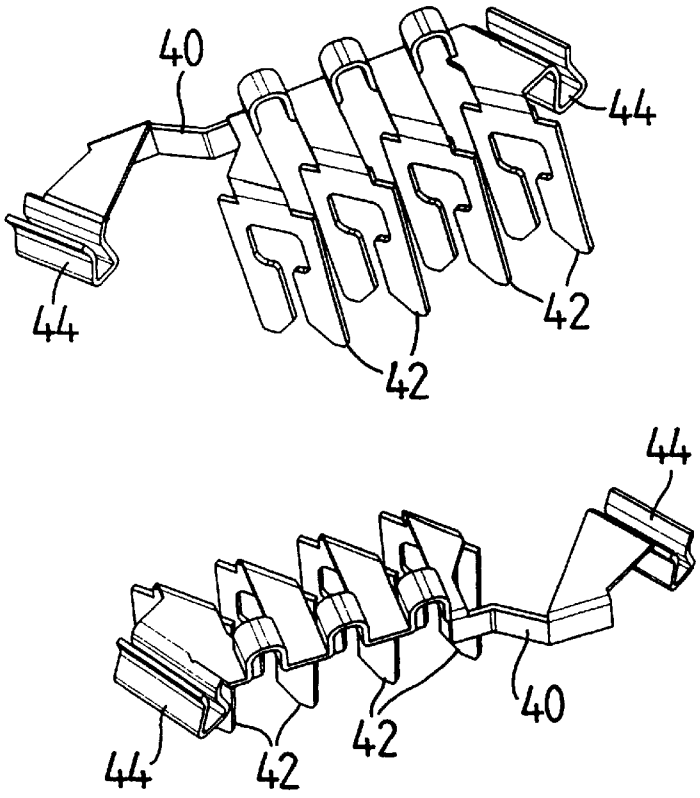
FIG. 5C is a perspective view of the neutral electrical contact of the first embodiment.

FIG. 5C illustrates two views of the neutral input and output contacts and contact frame, 5 which is similar in construction to the arrangement described in connection with FIG. 5A, although the output contacts 44 are arranged at angles to suit the orientation of the respective plug pins to be received therein.

Figure 5B:
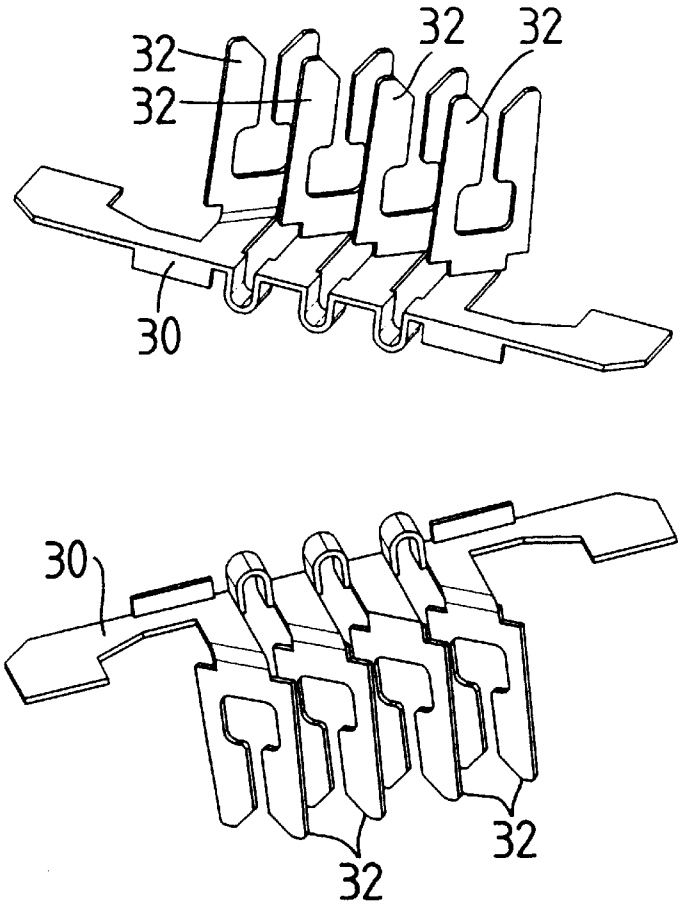
FIG. 5B is a perspective view of the energized electrical contacts of the first embodiment.

FIG. 5B illustrates the energized input contacts and contact frame 32, 30, which is also similar in construction to the ground input contacts and contact frame 52, 50. In the case of the energized, however, the output contacts are formed separately, as discussed above, and are arranged adjacent the ends of the contact frame 30 as illustrated in FIG. 4.

In one form of this embodiment of the invention the input contacts may be formed to individually suit different size wires or cables. For example, two of the input contact from each of the energized, neutral and ground might be provided with a relatively narrow gap between the contact edges, and the other two input contacts with a relatively wide gap between respective contact edges, to suit different gauges of cable or wire conductors. Alternatively, the resilience of the legs of the input contacts may be such that different sized slots are not required in order to accommodate different gauges of wire or cable in a given input contact.

As seen best in FIG. 2, the slots between legs of the input contacts for the energized, neutral and ground are accessible in the wire contact opening 24 of the respective rows of input contact cover turrets 20, 21 and 22. The wire contact openings, and thus input contacts, are accessible from the rear of the electrical power outlet 2, even with the base portion cover 4 and face plate 6 fitted, but normally project into the wall or the like when the electrical power outlet is mounted for use.

Figure 6:
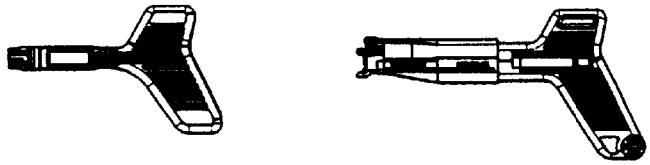
FIG. 6 is an illustration of two different tools which are adapted for insertion of wires/cables into input electrical contacts of the first embodiment.

Referring to FIG. 2, the wire contact openings 24 are in the form of gaps in the input contact cover turrets (20, 21, 22), and the individual input contacts (32, 42, 52) are positioned transversely (preferably at about 45°) in respective individual wire contact openings 24. In this way, a wire or cable can be inserted in a particular wire contact opening 24 from the rear of the base portion 12 to engage the corresponding input contact. The wire/cable end is inserted with its length generally parallel to the plane of the base portion and at right angles to the extent of the contact cover turret or input contact frame. Because the input contacts are angled with respect to a wire inserted in the corresponding contact opening, the edges of the input contact slot may be more effective in cutting through the wire insulation so as to make electrical connection with the conductor therewithin. Wires can be conveniently inserted in the wire contact openings to make connection with the input contacts by means of a tool known as a "Terminator" (trademark) tool, available from Krone (Australia) Technique Pty Limited. FIG. 6 illustrates a stadard tool (left) and a wire cut-off tool (right).

Figure 7:
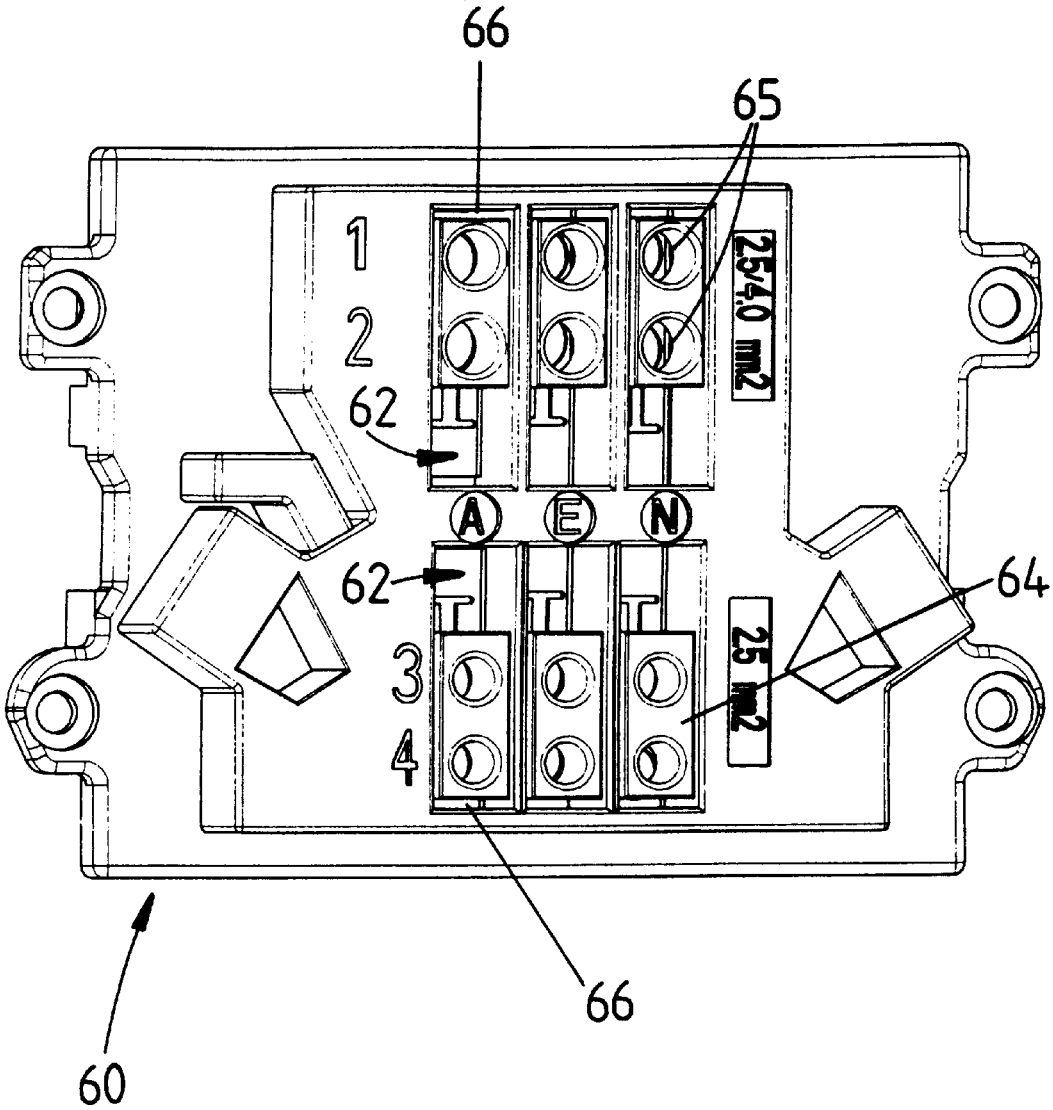
FIG. 7 is a rear view of an electrical power outlet base portion constructed in accordance with a second embodiment of the invention.
Figure 8:
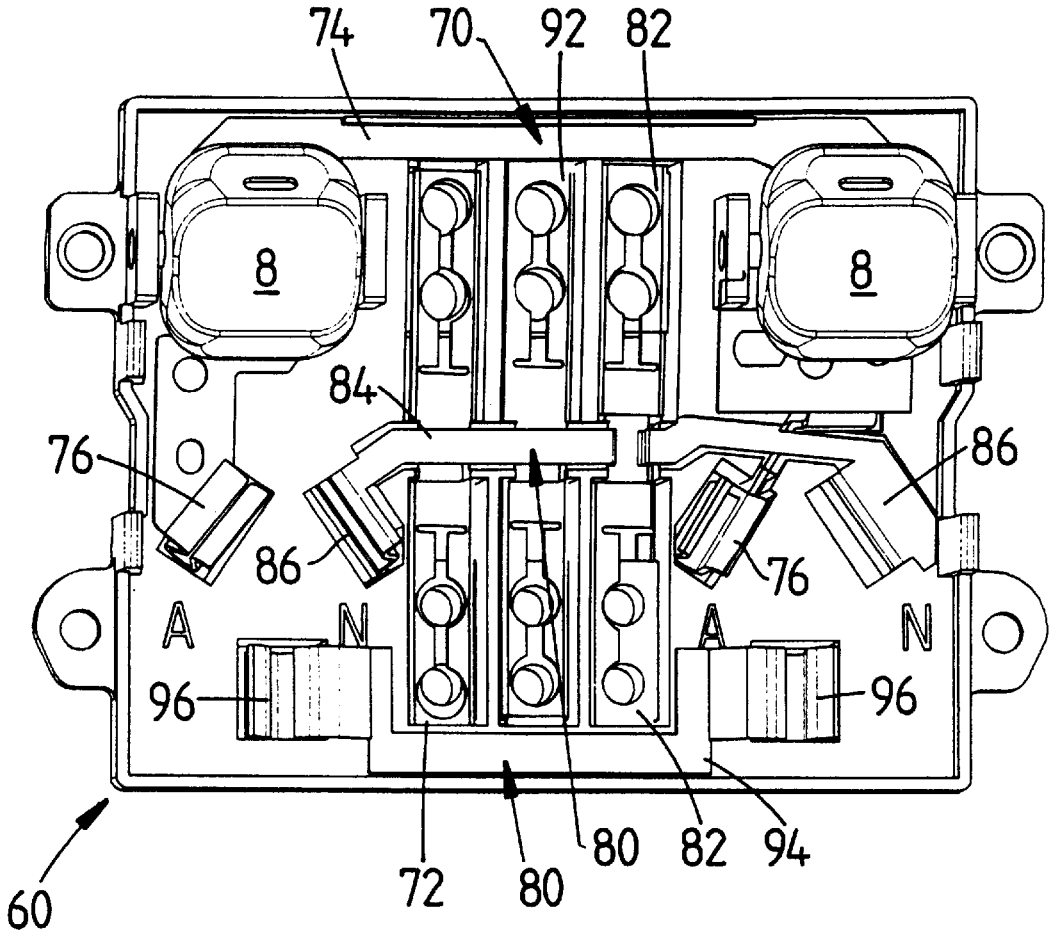
FIG. 8 is a front view of an electrical power outlet base portion constructed in accordance with the second embodiment.
Figure 9:
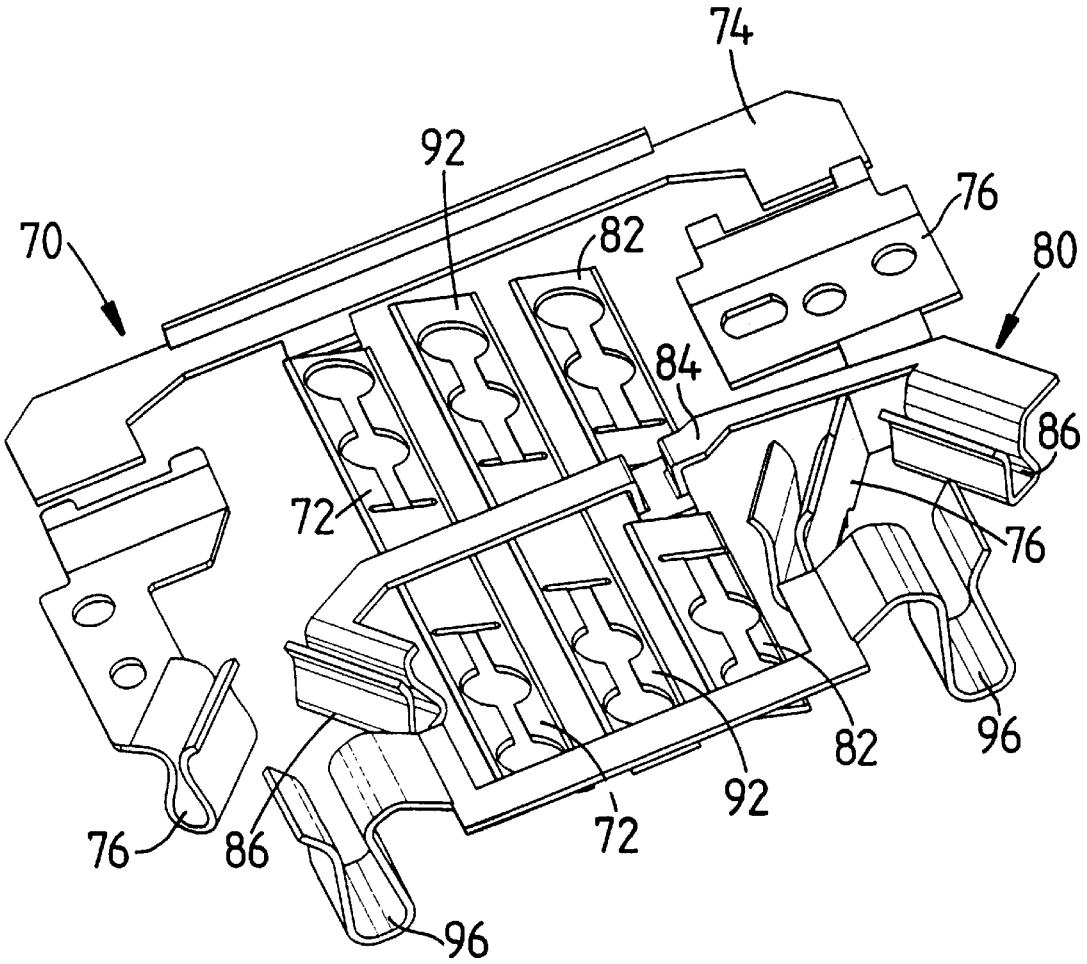
FIG. 9 is a front view of the set of electrical contacts of the second embodiment.

FIG. 7 illustrates the rear of a base portion 60 constructed in accordance with a second embodiment of the present invention. FIG. 8 shows a front view of the base portion 60, and FIG. 9 shows the layout of energized, neutral and ground contacts for the second embodiment.

The base portion 60 is constructed generally similar to the base portion 12 of the first embodiment, although the input contacts and contact frames are differently constructed and arranged, and as a consequence the longitudinally extending sets of input contact cover turrets of the first embodiment are replaced by transversely extending contact recesses 62 and respective carrier blocks 64. For each of the energized, neutral and ground, the rear of base portion 60 is provided with two elongate contact recesses 62 arranged end to end. The contact recesses for the energized, ground and neutral are arranged side by side so as to form two sets of three parallel contact recesses 62 positioned at the rear of the base portion 60 between the positions of the sockets 10 on the front of the electrical power outlet.

Within each contact recess 62 there is mounted a carrier block 64. The carrier block 64 is shorter in length than the elongate recess, and is slidably movable from one end of the recess to the other. The carrier block 64 has two wire apertures 65 formed therethrough, extending from the rear of the base portion to the input contacts mounted at the front thereof.

Figure 10A:
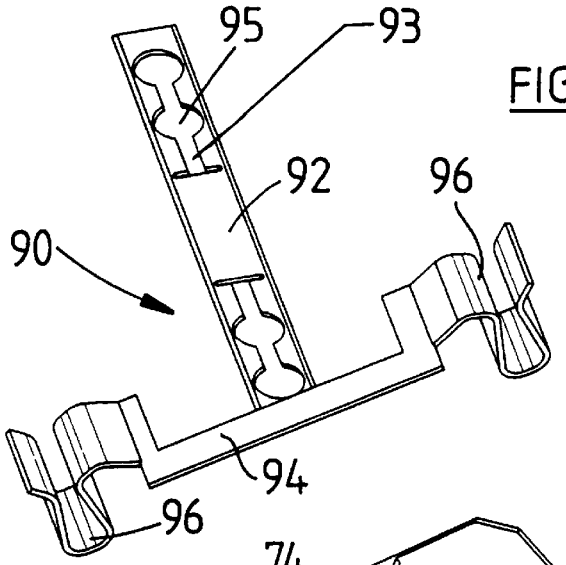
FIG. 10A is a perspective view of the ground electrical contacts of the second embodiment.
Figure 10B:
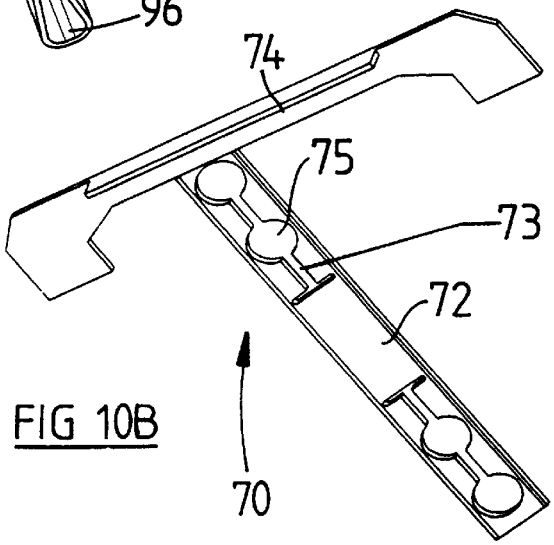
FIG. 10B is a perspective view of the energized electrical contacts of the second embodiment.

FIG. 10B shows the energized contact 70 for the second embodiment in isolation, without energized output contact portions 76. The energized contact 70 comprises an elongate input contact portion 72, with a frame portion 74 extending transversely from one end thereof. As seen best in FIG. 9, when viewed from the front of the electrical power outlet, the energized input contact portion 72 lies to the left hand side of the base portion structure, with the contact frame 74 arranged toward the top of the structure and extending to each side to adjacent the respective energized output contacts 76 for connection with the respective switches 8 (not shown in FIG. 9). The input contact portion 72 comprises two (upper and lower) sets of input contacts, each set of input contacts comprising two contact openings 75 and respective contact slots 73. Each contact opening 75 comprises a substantially circular hole, and each contact slot extends from one side of the circular hole and has substantially parallel edges. The openings 75 and slots 73 are arranged in alternating fashion in each set, and the sets are disposed to opposite ends of the input contact portion 72. The input contact portion 72 is generally planar, but is angled with respect to the plane of the frame portion 84. The frame portion 84 and input contact portion 72 may be integrally formed, as discussed previously in relation to the first embodiment, or may be formed separately and joined together by welding, soldering, riveting or the like.

Figure 10C:
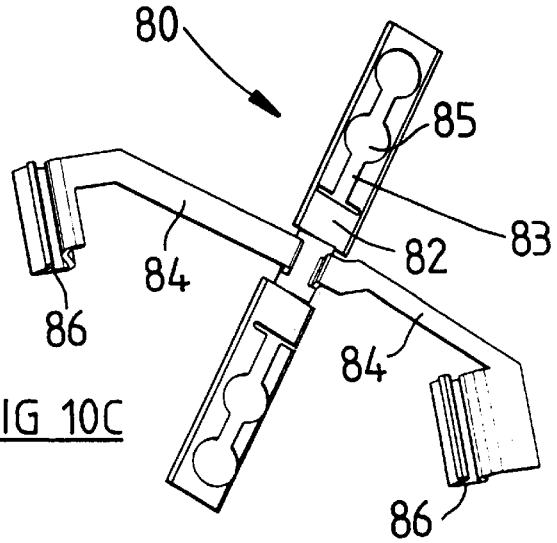
FIG. 10C are views of the neutral electrical contacts of the second embodiment.

FIG. 10C illustrates a neutral contact 80 having an input contact portion 82 which is generally similar in construction to the input contact portion 72 of the energized contact 70. In this case, however, the frame portion 84 extends from the center of the input contact portion 82, and is integrally formed with output contact portions 86 at the ends thereof remote from the input contact portion. Furthermore, the frame portions 84 are raised slightly with respect to the input contact portion, to enable the frame portion to extend over the energized and ground contacts 70, 90, without electrical connection therebetween, when the neutral contact 80 is in situ in the base portion of the power outlet, as shown arranged in FIG. 9. The neutral input contact portion 82 is disposed to the right hand side of the base portion structure, when viewed from the front, as shown in FIGS. 8 and 9. The ground contact 90, illustrated in FIG. 10A, is also generally similar in construction to the neutral and energized contacts, although the frame portion 94 thereof extends transversely from the opposite end of the input contact portion 92, as compared to the energized contact 70. The frame portion 94 is integrally formed with output contact portions 96 at the ends thereof remote from the input contact portion.

Referring particularly to FIG. 7, as mentioned the carrier blocks 64 are slidably movable within the contact recesses 62. With the carrier block 64 disposed at one end of the respective contact recess 62, the wire apertures 65 align with the contact openings 75 of the respective set of input contacts. When the carrier block 64 is moved to the other end of the contact recess, the wire apertures 65 align with the corresponding contact slots 73 of the respective set of input contacts. With the carrier blocks in the first mentioned configuration, the end of an insulated wire or cable may be inserted into a wire aperture 65 from the rear of the base portion 60, to project through the corresponding input contact opening 75. If the carrier block 64 is then moved within the contact recess to the other end thereof, then the end of the wire or cable which projects thereinto is forced into the angled contact slot 73. This action causes edges of the slot 73 to cut through the insulative sheath of the wire or cable and make electrical connection with the conductor therein. The movement of the carrier block 64 with wire or wires projecting thereinto can be conveniently achieved by the use of a screw driver or the like with a lever action against an end of the carrier block and an end of the recess 62. For this purpose, the carrier blocks 64 and recesses 62 may be constructed so that a lever opening 66 remains between the recess end and carrier block end, to accommodate a flat projection such as screw driver tip. Once electrical connection has been established to a wire or cable, the corresponding carrier block 64 is left in place at that end of the contact recess. If removal of the wire/cable is desired, a similar lever action may be applied to the carrier block from the other end so as to force the wire/cable back into the corresponding contact opening 75 for extraction of the end of the wire/cable.

Figure 11:
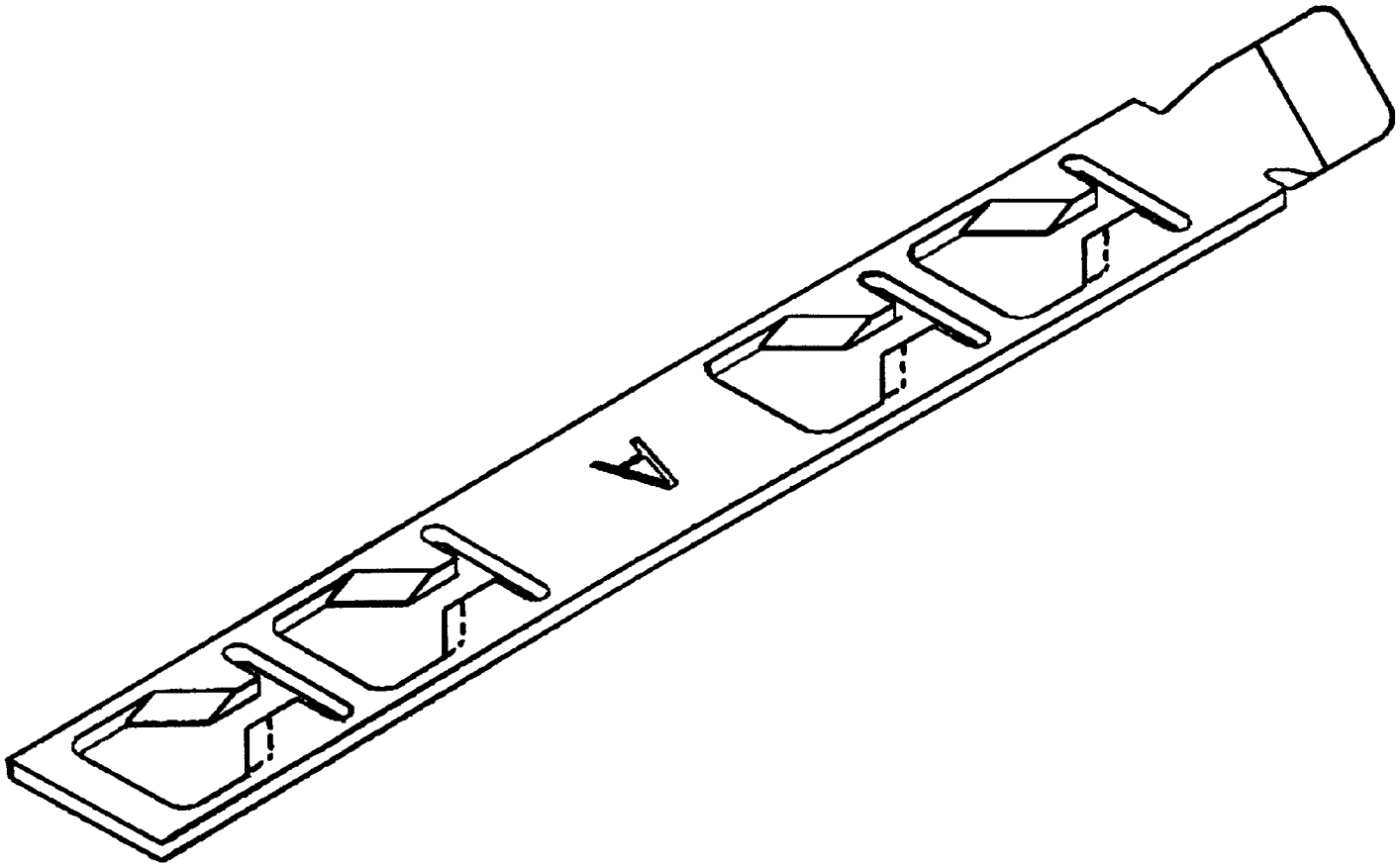
FIG. 11 is a perspective view of an input contact portion according to a variation of the second embodiment.

It will be appreciated that it is not essential for the input contact openings and slots to be shaped as illustrated in FIGS. 7 to 10, and many variations are possible. An input contact portion according to a variation of the second embodiment is illustrated in perspective view in FIG. 11. In this case, the input contact portion has been formed separately from the frame portion, and is constructed to enable it to be joined to a frame portion at one end thereof by welding, soldering, rivetting or the like. The contact openings and respective contact slots shown in FIG. 11 are also shaped differently than those previously discussed, wherein the contact openings are generally rectangular with tapered portions leading into the respective contact slots. Also, the individual contact openings and slots are formed separately on the input contact portion illustrated in FIG. 11, which may be desirable for improved structural rigidity of the contact portion, particularly if it is made from relatively thin sheet material or the like. Furthermore, the contact slots as shown in FIG. 11 may have chamfers on opposite sides of the slot edges to aid in insulation displacement and notching of the wire conductor when inserted therein. All of the slot and aperture features may be arranged in the same direction, or one pair may be arranged in the opposite direction to the other, for example.

From the foregoing description, it will be readily apparent to those of ordinary skill in the art that the electrical power outlets disclosed herein and the construction and arrangement of the input contacts in particular allow for simple and fast connection to electrical wires/cables which was not possible using conventional connectors. It is not necessary to remove insulation from the wire/cable before making the connection, and the connecting procedure is particularly simple, and requires only a simple tool.

The foregoing detailed description of the present invention has been presented by way of example only, and is not intended to be considered limiting to the present invention as defined in the claims appended hereto. While specific embodiments of the invention have been shown and described in detail to illustrate the application of the principles of the invention, it will be understood that the invention may be embodied otherwise without departing from such principles.

What is claimed is:

1. An electrical power outlet having at least one power outlet socket with an associated electrical power source, the power outlet comprising:

an element defining a plurality of socket receptacles;

outlet electrical contacts associated with said element for making electrical connection with respective pins of an electrical plug when the electrical plug is inserted in the socket receptacles;

a plurality of input electrical contacts associated with said element, said input electrical contacts being electrically coupled to each outlet electrical contact for making electrical connection between the outlet electrical contacts and the electrical power source, each input electrical contact being adapted to make electrical connection with a wire or cable having an insulating sheath, wherein each input electrical contact has at least one insulation cutting edge or surface adapted to cut through the insulating sheath of an insulated wire or cable, the edge or surface for making electrical connection to a conductor therein upon a relative movement between the wire or cable and the input electrical contact; and a switch associated with said element and coupled between at least one of said input electrical contacts and at least one of corresponding said outlet electrical contacts to enable control of electrical power supply to the at least one power outlet socket.

2. An electrical power outlet as claimed in claim 1, wherein each power outlet socket has three outlet electrical contacts corresponding to a respective energized connection, neutral connection and ground connection, and wherein a plurality of said input electrical contacts are connected to each said outlet electrical contact.

3. An electrical power outlet as claimed in claim 2, wherein two power outlet sockets and four input electrical contacts are provided for each of the energized connection, neutral connection and ground connection.

4. An electrical power outlet as claimed in claim 1, wherein each of the input electrical contacts include a pair of generally parallel contact legs having a slot between respective opposed contact edges of the contact legs, a base of the contact legs being joined together and the ends of the contact legs being tapered so that the slot opens outwardly thereat to facilitate insertion of an insulated wire or cable into the slot from an open end, and wherein upon insertion of the insulated wire or cable transversely of the slot, the contact edges are adapted to cut through the insulation sheath and make electrical connection to the wire or cable conductor therewithin.

5. An electrical power outlet as claimed in claim 4, wherein engagement of the wire or cable in the slot between the contact edges provides a secure physical connection between the input electrical contact and the wire or cable as well as the electrical connection to the conductor.

6. An electrical power outlet as claimed in claim 5, wherein the contact legs are resiliently biased against displacement away from one another such that the input electrical contact is constructed to receive and make connection to a range of different insulated wire or cable gauges.

7. An electrical power outlet as claimed in claim 3, further comprising a connecting frame provided for each of said energized, neutral and ground connections to which the corresponding input electrical contacts and outlet electrical contacts are connected.

8. An electrical power outlet as claimed in claim 7, wherein said connecting frame, input electrical contacts and outlet electrical contacts for the ground and neutral connections are all integrally formed from a single piece of conducting metal material.

9. An electrical power outlet as claimed in claim 1, wherein each of the input electrical contacts comprises a generally flat contact portion with a slot formed therein, the slot having a narrow holding portion between generally parallel contact edges adjacent to a widened insertion portion.

10. An electrical power outlet as claimed in claim 9, wherein the contact of the of the holding portion are spaced so that a wire or cable insulation cut by the contact edges so that the edges make electrical connection with the conductor of the wire or cable.

11. An electrical power outlet as claimed in claim 10, wherein said insertion portion is dimensioned so that an end of a wire or cable can be inserted therein transversely of the plane of the flat contact portion for subsequent movement along the slot into the holding portion.

12. An electrical power outlet as claimed in claim 11, wherein each input electrical contact is provided with a slidable member adjacent one flat side of said contact portion of said input electrical contact, and wherein said slidable member has an aperture therethrough and is slidable so that the aperture can moved from alignment with the insertion portion to alignment with the holding portion.

13. An electrical power outlet as claimed in claim 12, wherein each input electrical contact has a plurality of holding portions with adjacent insertion portions, and wherein each said slidable member has a plurality of corresponding apertures for receiving wire or cable ends so that a plurality of wires or cables can be connected to each input electrical contact.

14. An electrical power switching unit adapted for use in switching electrical power, the switching unit comprising:

an inlet electrical contact;

a corresponding outlet electrical contact;

a switching device comprised of an electrical contact part coupled between said inlet electrical contact and said outlet electrical contact for electrically connecting and disconnecting the corresponding inlet and outlet contacts to control the supply of electrical power between electrical circuits coupled to said inlet electrical contact and said outlet electrical contact, each of said inlet electrical contact and said outlet electrical contact being adapted to make electrical connection with a wire or cable having an insulating sheath each of said inlet electrical contact and said outlet electrical contact has at least one insulation cutting edge or surface adapted to cut through the insulative sheath of insulated wire or cable and make electrical connection to the conductor therein upon a relative movement between the wire or cable and the electrical contact;

a housing element connected to each of said inlet electrical contact, said outlet electrical contact and said switching device electrical contact part; and a switching device actuator mounted on said housing element for actuating said switching device upon movement of said switching device actuator between first and second positions.

15. An electrical power switching unit as claimed in claim 14, wherein each of the electrical contacts comprises a pair of generally parallel contact legs having a slot between respective opposed contact edges of said contact legs, a base of said contact legs being joined together and ends of said contact legs being tapered so that said slot opens outwardly thereat to facilitate insertion of an insulated wire or cable into the slot from the open end, and wherein upon insertion of the insulated wire or cable transversely of said slot said contact edges are adapted to cut through the insulating sheath and make electrical connection to the wire or cable conductor therewithin, wherein engagement of the wire or cable in said slot between the contact edges provides a secure physical connection between the electrical contact and the wire or cable as well as the electrical connection to the conductor.

16. An electrical power switching unit as claimed in claim 15, wherein said contact legs are resiliently biased against displacement away from one another such that at least one of said inlet electrical contact and outlet electrical contact is constructed to receive and make connection to a range of different insulated wire or cable gauges.

17. An electrical power switching unit as claimed in claim 14, wherein each of the electrical contacts comprises a generally flat contact portion with a slot formed therein, said slot having a narrow holding portion between generally parallel contact edges adjacent to a widened insertion portion.

18. An electrical power switching unit as claimed in claim 17, wherein said contact edges of said holding portion are spaced so that a wire or cable inserted therein will have its insulation cut by the contact edges so that the edges make electrical connection with the conductor of the wire or cable.

19. An electrical power switching unit as claimed in claim 18, wherein the insertion portion is dimensioned so that an end of a wire Or cable can be inserted therein transversely of the plane of the flat contact portion for subsequent movement along the slot into the holding portion.

20. An electrical power outlet as claimed in claim 19, wherein each electrical contact is provided with a slidable member adjacent one flat side of the contact portion of the electrical contact, and wherein said slidable member has an aperture therethrough and is slidable so that the aperture can moved from alignment with said insertion portion to alignment with said holding portion.

21. An electrical power outlet as claimed in claim 20, wherein said input electrical contact has a plurality of holding portions with adjacent insertion portions, and wherein said slidable member has a plurality of corresponding apertures for receiving wire or cable ends so that a plurality of wires or cables can be connected to each input electrical contact.

22. An electrical power outlet having at least one power outlet socket with an associated electrical power source, the power outlet comprising:

an housing element outlet electrical contacts formed of a conductive portions connected to said housing element wherein each outlet electrical contact is one of:

a contact adapted to make electrical connection with a wire or cable having an insulating sheath with each outlet electrical contact having at least one insulation cutting edge or surface adapted to cut through the insulating sheath of insulated wire or cable and make electrical connection to the conductor therein upon a relative movement between the wire or cable and the electrical contact, and a contact defining a plurality of members for making electrical connection with respective pins of an electrical plug, wherein the housing element has socket receptacles;

input electrical contacts formed of a conductive portions connected to said housing, said input electrical contacts making electrical connection with a wire or cable having an insulating sheath, wherein each input electrical contact has at least one insulation cutting edge or surface adapted to cut through the insulating sheath of an insulated wire or cable, the edge or surface for making electrical connection to the conductor therein upon a relative movement between the wire or cable and the input electrical contact;

a switch actuator connected to said housing element;

a switching device formed by an electrically conductive part disposed between at least one of said input electrical contacts and at least one of corresponding said outlet electrical contacts and moveable between a contact position and a non contact position for making and breaking electrical connection, said switch being connected to said electrically conductive part for actuating said switching device to enable control of the electrical power supplied to the at least one outlet electrical contacts.

23. An electrical power outlet as claimed in claim 22 wherein said at least one of said input electrical contacts and said at least one of said outlet electrical contacts are two separate electrically conductive members, each positioned for contact with said switching device electrically conductive part, in at least on position of said switching device electrically conductive part.

24. An electrical power outlet as claimed in claim 23 wherein another of said input electrical contacts and said outlet electrical contacts is formed as a single integral electrically conductive element with an input contact portion and an output contact portion.

25. An electrical power switching unit as claimed in claim 23, wherein each of the electrical contacts comprises a pair of generally parallel contact legs having a slot between respective opposed contact edges of said contact legs, a base of said contact legs being joined together and ends of said contact legs being tapered so that said slot opens outwardly thereat to facilitate insertion of an insulated wire or cable into the slot from the open end, and wherein upon insertion of the insulated wire or cable transversely of said slot contact edges are adapted to cut through the insulating sheath and make electrical connection to the wire or cable conductor therewithin.

* * * * *